United States Patent [19]

Gancia

[11] Patent Number: 4,719,785

[45] Date of Patent: Jan. 19, 1988

[54] METHOD AND APPARATUS FOR GUIDING A BILLET INTO A PRESSURE-PIERCING ROLLING MILL

[75] Inventor: Emanuele Gancia, Milan, Italy

[73] Assignee: Innse Innocenti Santeustacchio S.p.A., Brescia, Italy

[21] Appl. No.: 875,563

[22] Filed: Jun. 18, 1986

[30] Foreign Application Priority Data

Jun. 28, 1985 [IT] Italy ..... 21331 A/85

[51] Int. Cl.[4] ..... B21B 39/16

[52] U.S. Cl. ..... 72/250; 72/251; 226/126; 414/17; 384/39

[58] Field of Search ..... 226/120, 125, 126, 134, 226/195; 414/16, 17, 18; 308/3 R, 3 A, 5 R, 6 R, 6 A; 72/209, 250, 251, 428

[56] References Cited

U.S. PATENT DOCUMENTS

| | | | |
|---|---|---|---|
| 2,033,644 | 3/1936 | Rendleman et al. | 72/251 |
| 3,279,585 | 10/1966 | Shen | 72/251 |
| 4,006,618 | 2/1977 | Yanagimoto et al. | 72/251 |
| 4,196,942 | 4/1980 | Calmes et al. | 72/250 |
| 4,470,285 | 9/1984 | Cathaneo et al. | 72/251 |

*Primary Examiner*—W. D. Bray

*Attorney, Agent, or Firm*—Fitzpatrick, Cella, Harper & Scinto

[57] ABSTRACT

A method is disclosed wherein, to guide a billet into a pressure-piercing mill, the same pusher is utilized as is normally provided to force the billet through the nip of the mill rolls.

5 Claims, 4 Drawing Figures

METHOD AND APPARATUS FOR GUIDING A BILLET INTO A PRESSURE-PIERCING ROLLING MILL

This invention relates to a method and related apparatus for guiding a billet into a pressure-piercing rolling mill along the rolling axis thereof.

A Pressure-Piercing Mill (hereinafter referred to as PPM for brevity) is a piece of equipment which is employed to convert a square billet into axially bored round stock.

A PPM would usually comprise two round-grooved rolls, a boring bit carried at the end of spindle (or bit holding shaft) extending along the rolling axis from the PPM delivery end, a hydraulic or mechanical pusher for forcing the billet through the nip of the mill rolls and against the boring bit, and infeed guide.

A requisite condition to obtain cylindrical blanks which are bored exactly along their axes is that the corresponding billets be firmly held in proper alignment to the rolling and boring axis, from the moment they are started into the nip of the mill rolls until they leave said nip.

To meet this requirment, a PPM is bound to include an infeed guide and a delivery guide.

An infeed guide would be generally in the form of straight tunnel having a cross-sectional shape that matches substantially that of the billet to be bored, the tunnel being defined by either lineals or a roller plurality.

A billet, oncoming from a continuous casting systm, is conveyed to the PPM over specially provided roller runways, and is generally stopped laterally of the infeed guide wherein it must be positioned in axial alignment relationship.

In order to avoid problems (such as misalignment, seizing, jamming) inherent to axial insertion of the billet, and infeed guide has been used heretofore which comprises two structurally separate sections, a first seciton which furthest from PPM and is referred to as the billet checking and centering guide, and a second section, closer to the PPM which forms the infeed guide proper.

The first section (the billet checking and centering guide comprises idler rollers arranged to delimit a tunnel-like passageway. The upright rollers ont he billet arrival side are shiftable to enable the billet to be loaded sideways into the guide.

It is for this reason (shiftable rollers) that in the pertinent art, and throughout this specification and appended claims, said checking and centering guide will be refered to as the C-guide, for brevity.

The second section (the infeed guide proper) comprises rollers, in general mounted idly, which delimit a tunnel-like passageway having such cross dimensions as not to interfere with the billet cross-section. That is, no clearance is provided between the rollers of this guide and the billet, and there exists instead a condition of interference whereby said rollers exert a rolling action on the billet, albeit to a minor extent. All this is designed to ensure an effective centered support for a billet entering the PPM in line with the rolling axis of the later.

However, in order for it to be effective, it is necessary that the rollers of the infeed guide be provided with a comparatively large diameter dimension, and accordingly, there exists of necessity a substantial distance between the rollers of the inlet stand which lie closest to the PPM and the PPM rolls.

Consequently, a trailing portion of the billet, which portion would have the same length as said distance, is left unguided while the rolls and boring bit are acting on it.

For this reason, the bore at said trailing portion of the billet is often offset from the axis to such an extent as to make it necessry to cut off and discard that trailing portion.

The problem underlying this invention is to arrange for a billet entering a PPM to be so guided as to ensure guided support also for the billet trailing portion, until the trailing end of the billet enters the nip of the PPM rolls.

This problem is solved according to the invention by a method of guiding a billet into a PPM, which consists of securing a billet in axial alignment to the pusher, guiding said pusher along the rolling axis, and releasing the pusher from said billet on its end reaching the nip of the rolls.

Advantageously, and in accordance with a feature of this invention, the pusher is guided in the C-guide section of the PPM infeed guide.

The invention features and advantages will be more clearly understood from the following description of a method, and its related apparatus, for guiding a billet into a PPM, in conjunction with the accompanying drawings, given herein by way of illustration and not of limitation, and where:

Figure 1:
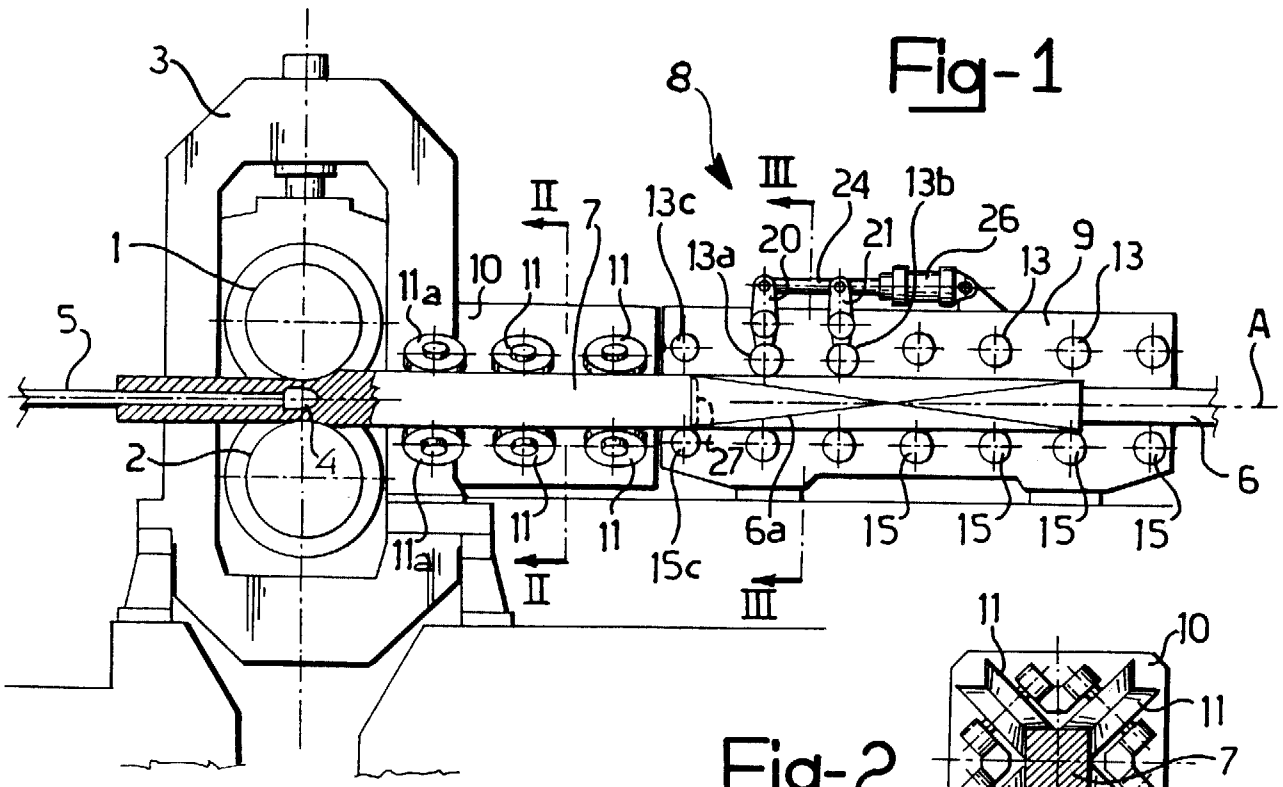
FIG. 1 shows diagramatically a side view of a pressure-piercing mill (PPM) implementing the method of this invention.

With reference to FIG. 1, a PPM comprises two rolls 1,2 with round grooves, which are supported conventionally on a stand 3, a boring bit 4 carried at the end of a shaft or spindle 5 which extends along the rolling axis A from the delivery end of the PPM, and a pusher 6, either hydraulically or mechanically operated, for forcing a billet 7 through the nip of the rolls 1,2 against the boring bit 4.

An infeed guide, generally indicated at 8, comprises a roller guide 10, placed close against the stand 3 of the PPM, and a C-like guide 9 placed upstream and in line with the roller guide 10.

Figure 2:
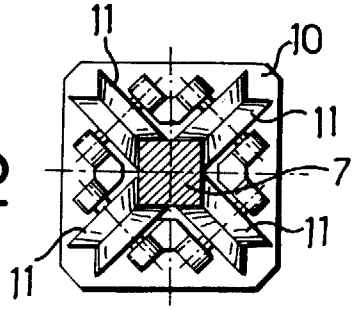
FIG. 2 is an enlarged scale sectional view taken along the line II—II in FIG. 1.

According to a preferred embodiment, the rollers 11 in the guide 10 have substantially V-like grooves (FIG. 2) and are laid out to engage respective corner portions of the billet 7 so as to fully encircle it.

The guide 9 (FIGS. 3 and 4) has idler rollers 12,13,14 and 15 which guide the billet 7 by engaging it from opposite sides with substantial play. As is known, this guide 9 is construcuted such that a billet can be loaded sideways thereon. To accomplish this, the rollers 12 arranged along the billet oncoming side from a continuous casting system, for example, are displaceable away from said guide 9 (open guide condition or C-guide). In particular, all the rollers 12 are carried on a single beam 16, pivoted around an axle 17 supported on the framework 9*a* of the guide 9 and extending parallel to the rolling axis A. One or more hydraulic cylinders 18 operate to shift the beam 16 angularly around said axle 17 when a fresh billet is to be loaded on the guide 9.

Figure 3:
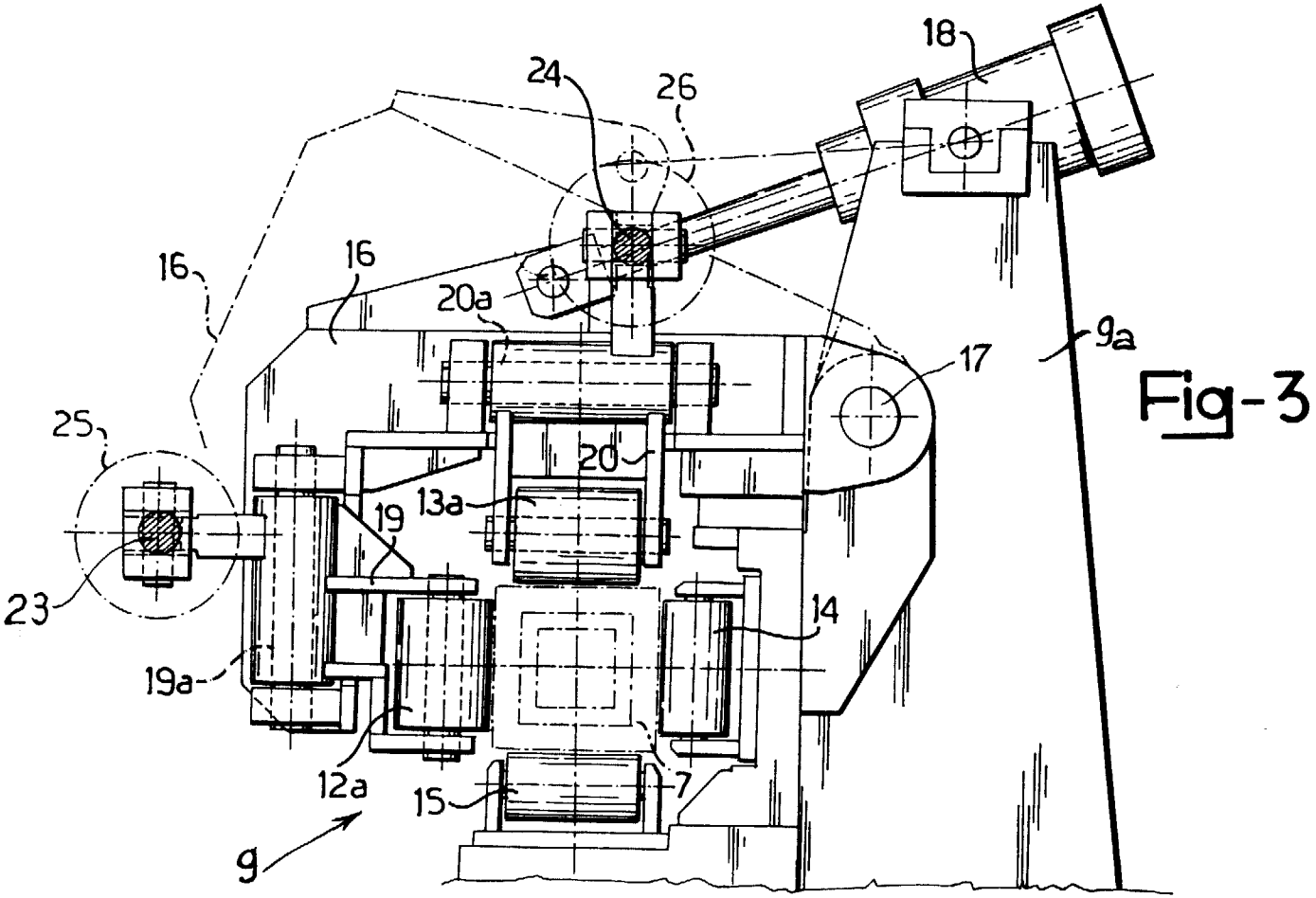
FIG. 3 is an enlarged scale sectional view taken along the line III—III in FIG. 1.
Figure 4:
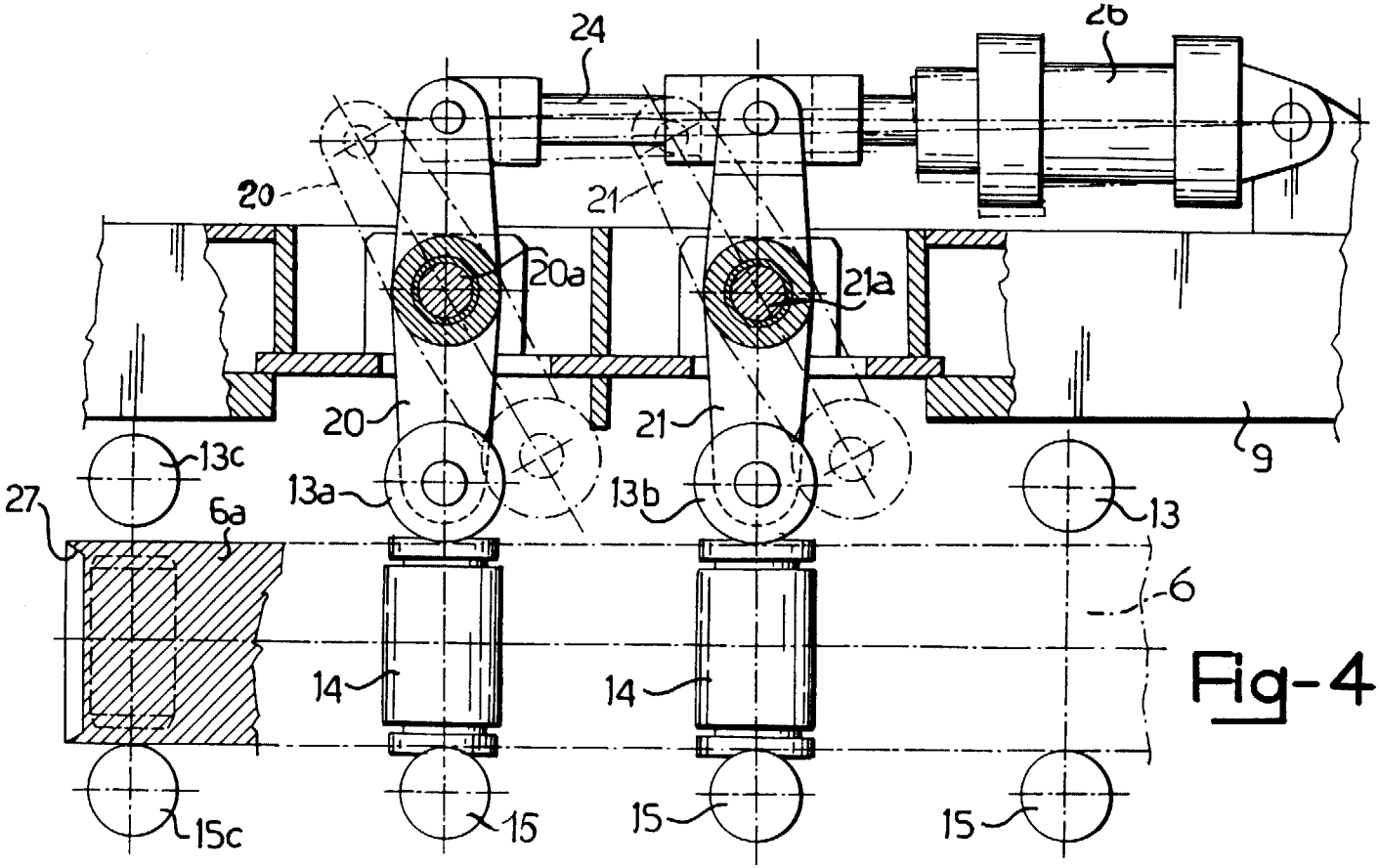
FIG. 4 is a further enlarged view of a detail of FIG. 1, shown in side elevation and partly in section.

A pair of rollers 12, of which only the roller indicated at 12*a* is shown in FIG. 3, and a pair of rollers 13, indicated at 13*a*, 13*b* in FIG. 4, are mounted on the ends of respective lever arms 19,20 and 21, the other ends whereof are pivoted to the piston rods 23,24 of hydraulic cylindrs 25, for the roller pair 12, and 26 for the roller pair 13. Each said lever arm is journalled on a pivot pin (19*a*,20*a*,21*a*) carried by the framework of the stand 9, around which pins said arms can be shifted angularly by operating the respective cylinders mentioned hereinabove.

An end section 6*a* of the pusher 6 has a square cross-sectional configuration and a length substantially equal to the distance between the nip of the PPM rolls 1,2 and the first shiftable roller pair of the C-guide 9, indicated at 12*a* and 13*a* in FIGS. 1 and 3.

The side dimension of the square cross-section of said section 6*a* is such that with said section 6*a* resting against or on the rollers 14,15, the longitudinal axis thereof will coincide with the axis of the guides 9 and 10 and the rolling axis A.

The section 6*a* of the pusher 6 is provided peripherally, at its free forward end, with a lip 27, slightly tapering conically inside and extending coaxial with said section 6*a*. Owing to the presence of the lip 27, the free forward end of the pusher 6 takes a substantially cup-like configuration.

Using an apparatus of the type of that shown in FIGS. 1 to 4, a method will now be described, according to the invention, for guiding a billet into a PPM along the rolling axis thereof.

In a starting condition, a billet 7 having a square cross-section, has been loaded sideways onto the C-guide 9, and the rollers 12 of said guide 9 have been returned to their operative positions (C-guide closed).

The shiftable idler rolles 12*a* and 13*a*,*b* are held by their respective cylinders 25,26 at furthest positions from the opposed idler rollers 14,15.

The cup-like forward end 27 of the pusher 6 is presently brought to bear against the billet 7 trailing end which begins to push the billet 7 toward the roller guide 10.

On the square section 6*a* of the pusher 6 reaching the shiftable idler rollers 12*a* and 13*a*, 13*b* of the guide 9, the hydraulic cylinder 25,26 are operated to mvoe said rollers to and against the square section 6*a*, urging it against the opposed idler rollers 14,15. The square section 6*a* of the pusher 6 is thus aligned positively to the longitudinal axis of the guides 9 and 10, and hence, to the rolling axis A.

On the billet 7 being started over the first roller pair 11 of the roller guide 10, it meets with a resistance effective to bring about a highly stable connection of the cup-like end of the pusher 6 to the billet itself. In that condition, the connection is of a substantially self-centering kind, and the billet 7 is aligned positively to the axis of the pusher 6.

This connected and aligned condition is maintained even as the trailing portion of the billet 7 "covers" the distance separating rollers 11*a* in the guide 10 lying closest the the PPM from the PPM rolls 1,2 while the pusher 6, or rather its square section 6*a*, is still firmaly guided and held on the rolling axis by the shiftable roller pairs of the C-guide.

On the cup-like forward end 27 of the pusher 6 reaching the nip of the rolls 1,2, the pusher is stopped and the trailing end of the billet 7 is released therefrom by the action of said mill rolls.

I claim:

1. A method for guiding a billet into a pressure-piercing mill which includes two round-grooved rolls defining a rolling axis, a boring bit on the delivery end of the pressure-piercing mill, a pusher to force a billet along said rolling axis through the nip of said rolls and against the boring bit, and an infeed guide, said method comprising the steps of securing the billet to said pusher in axial alignment relationship, guiding the pusher along the rolling axis and releasing the pusher from the billet when its end reaches the nip of said rolls.

2. A method according to claim 1, wherein the step of securing the billet to said pusher is carried out be removably securing the trailing end of the billet to the forward end of the pusher with a connection of the self-centering type.

3. A method according to claim 1, wherein the pusher is guided along the rolling axis in said infeed guide to the pressure-piercing mill.

4. A method according to claim 3 wherein the pusher is guided in a C-like guide, incorporating idler rollers, of said inlet guide.

5. An apparatus for guiding a billet into a pressure-piercing mill along a rolling axis thereof, said apparatus comprising two round-grooved rolls, a boring bit carried on the end of a bit holding shaft, and extending along the rolling axis from the delivery said of the pressure-piercing mill, a pusher constructed and arranged to force the billet through the nip of the rolls and against the boring bit, an infeed guide including a C-like guide incorporating idler rollers, at least one roller pair in said C-like guide are mounted to be moved toward and away from an opposed roller pair in the same guide by operation of respective acutators, and said pusher having an end portion formed with a square cross-section and a length substantially equal to the distance between the nip of said rolls and said one roller pair, said end portion of the pusher being provided peripherally at its free end with a conical inside lip forming a substantially cup-like configuration.

* * * * *

UNITED STATES PATENT AND TRADEMARK OFFICE

CERTIFICATE OF CORRECTION

PATENT NO. : 4,719,785

DATED : January 19, 1988

INVENTOR(S) : EMANUELE GANCIA

It is certified that error appears in the above-identified patent and that said Letters Patent is hereby corrected as shown below: Title page:

AT [56] IN THE REFERENCES

"2,033,644 3/1936 Rendleman et al. ..... 72/251" should read --2,033,649 3/1936 Rendleman et al. ..... 72/251--.
"4,470,285 9/1984 Cathaneo et al. ..... 72/251" should read --4,470,285 9/1984 Cattaneo et al. ..... 72/251--.

COLUMN 1

Line 32, "systm," should read --system,--.
Line 39, "and" should read --an--.
Line 40, "seciton" should read --section--.
Line 41, "which furthest" should read --which is furthest--.
Line 45, "guide" should read --guide)--.
Line 46, "ont he" should read --on the--.
Line 62, "later." should read --latter.--.

COLUMN 2

Line 7, "necessry" should read --necessary--.
Line 29, "diagramatically" should read --diagrammatically--.
Line 39, "1,2" should read --1, 2--.
Line 44, "1,2" should read --1, 2--.
Line 55, "12,13,14" should read --12, 13, 14--.

COLUMN 3

Line 4, "19,20" should read --19, 20--.
Line 5, "23,24" should read --23, 24--.
Line 6, "cylindrs" should read --cylinders--.
Line 8, "(19a,20a,21a)" should read --(19a, 20a, 21a)--.

UNITED STATES PATENT AND TRADEMARK OFFICE

CERTIFICATE OF CORRECTION

PATENT NO. : 4,719,785

DATED : January 19, 1988

INVENTOR(S) : EMANUELE GANCIA

It is certified that error appears in the above-identified patent and that said Letters Patent is hereby corrected as shown below:

COLUMN 3

Line 14, "1,2" should read --1, 2--.
Line 19, "14,15" should read --14, 15--.
Line 36, "rolles" should read --rollers--.
Line 36, "13a,b" should read --13a, 13b--.
Line 37, "25,26" should read --25, 26--.
Line 38, "14,15." should read --14, 15.--.
Line 45, "cylinder 25,26" should read --cylinders 25, 26--.
Line 45, "mvoe" should read --move--.
Line 47, "14,15." should read --14, 15.--.

COLUMN 4

Line 6, "1,2" should read --1, 2--.
Line 7, "firmaly" should read --firmly--.
Line 11, "1,2," should read --1, 2,--.
Line 33, "claim 3" should read --claim 3,--.
Line 40, "said" should read --side--.

Signed and Sealed this

Fourteenth Day of June, 1988

*Attest:*

DONALD J. QUIGG

*Attesting Officer*

*Commissioner of Patents and Trademarks*